US005927082A

United States Patent [19]

Sidelnikov et al.

[11] Patent Number: 5,927,082

[45] Date of Patent: Jul. 27, 1999

[54] GAS GENERATOR

[75] Inventors: Anatoly Evgenievich Sidelnikov, Kaliningrad; Gennady Sergeevich Nazarov, Krasnogorsk, both of Russian Federation

[73] Assignee: R-Amtech International, Inc., Bellevue, Wash.

[21] Appl. No.: 08/913,756

[22] PCT Filed: Apr. 12, 1996

[86] PCT No.: PCT/RU96/00091

§ 371 Date: Dec. 4, 1997

§ 102(e) Date: Dec. 4, 1997

[87] PCT Pub. No.: WO96/32162

PCT Pub. Date: Oct. 17, 1996

[30] Foreign Application Priority Data

Apr. 13, 1995 [RU] Russian Federation ..... 95 105 157

[51] Int. Cl.[6] ..... F17C 9/02

[52] U.S. Cl. ..... 62/50.2; 62/52.1; 62/70

[58] Field of Search ..... 62/48.1, 50.2, 62/52.1, 70

[56] References Cited

U.S. PATENT DOCUMENTS

| | | | |
|---|---|---|---|
| 3,672,182 | 6/1972 | Stowasser et al. | 62/70 |
| 4,295,346 | 10/1981 | Hoffman | 62/52.1 |
| 5,207,068 | 5/1993 | Bridden | 62/70 |
| 5,291,952 | 3/1994 | Arend | 169/71 |
| 5,309,722 | 5/1994 | Phillips, Jr. | 62/52.1 |

FOREIGN PATENT DOCUMENTS

| | | |
|---|---|---|
| 753436 | 8/1980 | U.S.S.R. . |
| 1470303 | 4/1989 | U.S.S.R. . |
| 2028127 | 3/1980 | United Kingdom . |
| 9525564 | 9/1995 | WIPO . |

*Primary Examiner*—Ronald Capossela
*Attorney, Agent, or Firm*—Rothwell, Figg, Ernst & Kurz, p.c.

[57] ABSTRACT

The proposed gas generator includes an isothermal vessel for a cryogenic liquid, the vessel being connected via an electrically controlled valve to a supercharging evaporator, a nozzle unit arranged in the upper part of the gasifier and connected by an electrically controlled valve to the lower part of the cryogenic liquid vessel, the gasifier being partially filled with a heat-accumulating substance and provided with a deflector situated above the nozzle unit and an electrically controlled sealing unit; in the lower part along the gasifier axis are provided a separator and a toroidal elastic casing attached to the bottom of the gasifier, the cavity of the casing communicating via the main pipe (provided with a pre-heating heat exchanger) with the upper part of the iso-thermal vessel, while the heat-accumulating substance is situated above the surface of the toroidal elastic casing, the electrically controlled sealing unit being situated at the separator outlet. The nozzle unit includes jet nozzles arranged in the lower side of the nozzle unit; water or solutions in water are used as the heat-accumulating substance.

3 Claims, 1 Drawing Sheet

GAS GENERATOR

FIELD OF THE INVENTION

The invention relates to gasification technology and can be used basically in the field of fire fighting for generating a large quantity of a fire extinguishing substance. This apparatus is necessary for extinguishing fires of large dimensions, such as fires in industrial plants, in closed or semi-closed buildings, for extinguishing burning liquids and gases, e.g. in oil and gas wells.

In a more narrow field of use the gas generator can be effectively applied in high performance laser technology, for instance for gas dynamic CO or $CO_2$ lasers which require the production of a great quantity of gas in a short time and at a low temperature.

The invention also relates to a field where an intensive supply of a gaseous product of high productivity is required. An example of such an area of usage is the production of nitrogen or other indifferent gases in containers of large storage capacity for preserving perishable foodstuffs, such as meat, eggs etc., and also for the preparation of tankers for transporting dry goods, which are used to carry corn or other foodstuffs.

DESCRIPTION OF THE BACKGROUND ART

At the present time various types of gas generators have been developed and are used in industry, which use external (electrical) energy as well as energy from th e environment, i.e. so-called surface gasifiers. One example of such a gasifier is the low-pressure gasifier GH-0,035/1,6 (SU 7 186 692) consisting of two cylindrical high-pressure tanks for storing cryogenic liquids under a pressure of up to 1,6 MPa and transporting them, and a production vaporizer for gasification. The production vaporizer consists of a block of panels arranged in a frame. The liquid product is discharged from the tank under pressure, is fed into the panels of the vaporizer and gasifies by heat exchange with the environment without additional use of energy. There is a whole range of low pressure cryogenic gas generators in use that work in analogy to this principle. However, they all have essential disadvantages, that is, their low productivity of the gaseous product in conditions of mass production. Thus, the maximum productivity of a GHK 25/1,6-2000 apparatus is 2200 cubic meters per hour (0,6 cubic meters per second) at an occupied space of 86,6 square meters and a mass of 19,2 tons.

More effective is a gas generator for use in fire extinguishing plants according to SU 1 678 391, which comprises an isothermal vessel, an electrically controlled valve, and a supercharging evaporator. The isothermal vessel in this gas generator is connected via an electrically controlled valve to the lower part of the evaporator of the gasifier and to a mixing chamber, in which turbulence-creating grids and filling inlets are arranged. However, the essential disadvantages of this gas generator are the following: Firstly, in this gas generator construction the quantity of gas generated cryogenic liquid is determined by the mass of the heat-accumulating inlet. Therefore an increase in the productivity of the apparatus is dependent on an increase in the mass of the heat-accumulating inlet, which, as a rule, is made of a metal with a great heat capacity or of natural materials, such as gravel, crushed stone etc. Secondly, additional time and the supply of external energy are needed to prepare the apparatus for the second working cycle, i.e. to reheat it.

SUMMARY OF THE INVENTION

The proposed gas generator comprises an isothermal vessel for a cryogenic liquid, said vessel being connected via an electrically controlled valve to a supercharging evaporator, a nozzle unit, a pre-heating heat exchanger, and a main supply pipe, in which the nozzle unit is arranged in the upper part of the gasifier and is connected via an electrically controlled valve to the lower part of the cryogenic liquid vessel, the gasifier being partially filled with a heat-accumulating substance and provided with a deflector situated above the nozzle unit and an electrically controlled sealing unit; in the lower part along the gasifier axis are provided a separator and a torodial elastic casing fixed to the bottom of the gasifier, the cavity of the casing communicating via the main pipe (provided with a pre-heating heat exchanger) with the upper part of the isothermal vessel, while the heat-accumulating substance is situated above the surface of the toroidal elastic casing, the electrically controlled sealing unit being situated at the separator outlet.

In the proposed gas generator the nozzle unit comprises jet nozzles arranged in the lower side of the nozzle unit. Moreover, water or solutions in water are used as the heat-accumulating substance.

The arrangement of the nozzle unit with the jet nozzles directed towards the gas stream enables an intensification of the heat exchange process.

The proposed gas generator, in which water or solutions in water are used as the heat-accumulating substance, does not have the disadvantages of the prior art. For the evaporation of the cryogenic liquid the energy stored in the heat-accumulating substance is used not only by way of its heat capacity, but also the energy of its crystallisation is used (the energy generated by the freezing of water). The amount of water needed for the evaporation, e.g. for the first kilogram of nitrogen is approximately 200 g altogether. This factor allows to greatly reduce the mass dimensions and the costs of the apparatus; and the energy consumption for fixing the inlet is reduced virtually to zero, since the ice that is formed is discharged from the apparatus to the outside with the rest of the water. Also, the productivity of the apparatus is determined only by the pace of the feeding of cryogenic liquid into the evaporator and by the pressure loss of the main outlet pipe for the gaseous product.

BRIEF DESCRIPTION OF THE DRAWINGS

The sole figure is a schematic illustration of a gas generator in accordance with one embodiment of the invention.

DETAILED DESCRIPTION OF THE INVENTION

Figure 1:
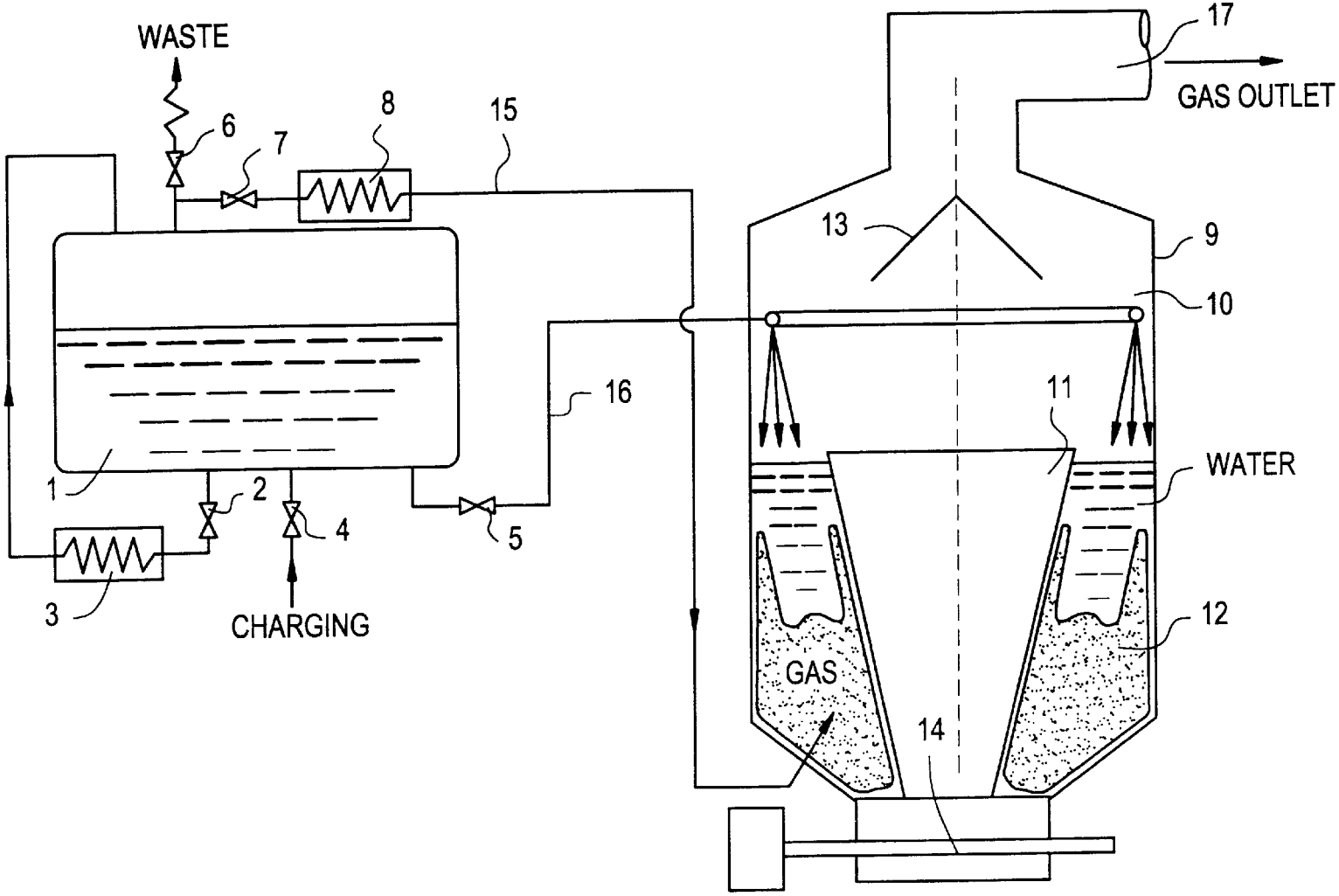

The apparatus (see FIG.) comprises an isothermal vessel for a cryogenic liquid (compressed nitrogen, for instance) 1, electrically controlled valves 2, 4, 5, 6, 7, a supercharging evaporator 3, a pre-heating heat exchanger 8, main supply pipes 15 and 16, by which the isothermal vessel 1 is connected to the gasifier 9. In the lower part of the gasifier a torodial elastic casing 12 and a separator 11 are situated; the space between the walls of the separator 11, the gasifier 9 and the elastic casing 12 being filled with water. The lower part of the gasifier is limited by an electrically controlled sealing unit 14. In the upper part of the gasifier 9 a nozzle unit 10 with jet nozzles, a deflector 13 and an outlet pipeline 17 for the gaseous product are arranged.

EMBODIMENT OF THE INVENTION

The proposed gas generator works in the following way. At the command to begin the technical process of the gasification of a cryogenic liquid the electrically controlled valve 2 starts to work, the liquid is supplied into the supercharging evaporator 3 and in gaseous form is fed into the upper part of the isothermal vessel 1. Thus the necessary pressure is built up in the isothermal vessel 1. When a predetermined pressure is reached in the isothermal vessel 1, the electrically controlled valves 5 and 7 open.

The liquid is supplied via the main supply pipe 16 into the nozzle unit 10 and is sprayed by the jet nozzles towards the water. When the cryogenic liquid comes into contact with the water, a violent evaporation process of the cryogenic liquid ensues; simultaneously, the water partially crystallizes. In order to prevent the formation of an ice skin on the water surface, a gaseous phase is supplied from the gas cushion in the upper part of the isothermal vessel through the main supply pipe 15 into the toroidal elastic casing 12, which, as it fills up, lifts the lower layers of water to its surface and expels the ice particles into the separator 11, thus clearing the water surface. The evaporated cryogenic liquid rises to the upper part of the gasifier 9 and flows through the duct 17 into the vessels of a fire extinguishing apparatus. To ensure that no ice particles are expelled together with the gas, a deflector 13 is arranged in the upper part of the gasifier. The flow that impinges the deflector is stopped and, changing direction, circumvents the deflector and is discharged into the duct 17, while the ice particles fall down into the separator 11. When the evaporation process is completed, the isothermal vessel 1 is discharged of the gaseous remains of the product through a discharge pipe. The electrically controlled sealing unit 14, situated in the lower part of the gasifier 9 opens; ice and remains of water are discharged from the gasifier 9.

This construction of a gasification apparatus makes it possible to achieve any desired evaporation intensity of a cryogenic liquid virtually without consumption of external energy (electrical energy is necessary merely for controlling the valves), determined only by the pace at which the cryogenic liquid is fed into the gasifier.

We claim:

1. A gas generator comprising an isothermal vessel for a cryogenic liquid, said vessel being connected via an electrically controlled valve to a supercharging evaporator, a nozzle unit, a pre-heating heat exchanger and a main supply pipe, characterized in that the nozzle unit is situated in the upper part of a gasifier and is connected via an electrically controlled valve with the lower part of the cryogenic liquid vessel, the gasifier being partially filled with a heat-accumulating substance and provided with a deflector situated above the nozzle unit and an electrically controlled sealing unit; in the lower part along the gasifier axis are provided a separator and a toroidal elastic casing attached to the bottom of the gasifier, the cavity of the casing communicating via the main supply pipe with the upper part of the isothermal vessel, while the heat-accumulating substance is situated above the surface of the toroidal elastic casing, the electrically controlled sealing unit being situated at the separator outlet.

2. A gas generator according to claim 1, characterized in that the nozzle unit comprises jet nozzles arranged in the lower side of the nozzle unit.

3. A gas generator according to claim 1, characterized in that water or solutions in water are used as the heat-accumulating substance.

* * * * *